United States Patent [19]

Karpp

[11] 4,094,036

[45] June 13, 1978

[54] FLOOR CLEANING DEVICE

[76] Inventor: Heinrich Karpp, Fahrenberg 19 A, 4300 Essen, Germany

[21] Appl. No.: 748,913

[22] Filed: Dec. 9, 1976

[30] Foreign Application Priority Data

Dec. 13, 1975 Germany ..... 2556277
Jul. 20, 1976 Germany ..... 2632509

[51] Int. Cl.[2] ..... A47L 13/11; A47L 13/257
[52] U.S. Cl. ..... 15/244 R; 15/223
[58] Field of Search ..... 15/117, 121, 177, 223, 15/224, 244 R, 245

[56] References Cited

U.S. PATENT DOCUMENTS

| | | | |
|---|---|---|---|
| 72,993 | 1/1868 | Fleckenstein | 15/245 |
| 75,154 | 3/1868 | Grebinger | 15/245 |
| 1,612,531 | 12/1926 | Peed | 15/223 UX |
| 2,112,462 | 3/1938 | Hawrylasz | 15/245 |
| 2,158,695 | 5/1939 | Foss | 15/245 |
| 2,197,927 | 4/1940 | Ehrlich | 15/245 |

FOREIGN PATENT DOCUMENTS

| | | | |
|---|---|---|---|
| 574,505 | 4/1924 | France | 15/146 |
| 577,831 | 9/1924 | France | 15/245 |
| 854,055 | 1/1940 | France | 15/245 |
| 1,153,866 | 9/1963 | Germany | 15/245 |

*Primary Examiner*—Daniel Blum
*Attorney, Agent, or Firm*—Michael J. Striker

[57] ABSTRACT

A floor cleaning device includes a holding member which is of generally U-shaped cross-sectional configuration, including a bight interconnecting two arms, which together bound a recess for partially receiving a cleaning element so that a cleaning edge of the latter is in an exposed working position. The cleaning element has a plurality of passages, and a plurality of connecting members, such as bolts, is received in the passages, being connected to one of the arms and extending toward the other arm. One of the arms can be removably mounted on the bight. The connecting members may be connected either directly to the other arm, or to a mounting plate which is connectable to one of the arms of the holding member. The passages are uniformly distributed in the cleaning element, preferably in the central region thereof, so that the cleaning element can be mounted on the holding member in any position in which one of the cleaning edges thereof is in the working position. The free ends of the connecting members may be threaded, and nuts can be threaded onto the same.

3 Claims, 2 Drawing Figures

1

8
9
4
16
17
6
7,13
12
3
5
2
15
14
10
11

1

16
4
17
3
5
2
18
21
22
6
21
19,20
10
11
14
15

FLOOR CLEANING DEVICE

BACKGROUND OF THE INVENTION

The present invention relates to a device for cleaning surfaces, and more particularly to a device for cleaning floors.

It has been already proposed to mount cleaning elements, such a wiping strip, of foam rubber or a similar water-absorbent material in a holding member in such a manner that a part of the cleaning element is clamped in the holding member, and another part thereof extends outwardly thereof to come into contact with the surface to be cleaned. So, for instance, it has already been proposed to fold a wiping strip so that it assumes a U-shaped configuration, and then to mount the folded wiping strip in the holding member so that the arms of the folded wiping strip extend outwardly of the holding member. A connecting rod may be arranged in the folded region of the wiping strip, which rod is connected, by a threaded connection, to the back of the holding member. Instead of using such connecting rod, it has also already been proposed to utilize screws only, which extend through openings in the folded region of the wiping element.

However, it has been established that the above-mentioned proposals leave much to be desired in many respects. First of all, as far as assembly is concerned, it is very difficult to fold the wiping element or strip which has a rectangular cross section and which is made of foam rubber, to assume the above-mentioned U-shaped configuration, and then to mount the folded wiping strip in the holding member. On the other hand, when the cleaning device is constructed according to this proposal, the consumption of the wiping strips is considerable, inasmuch as such wiping strips can be used and thus subjected to wear only at their free exposed margins. On the other hand, the folded portion of the wiping strip which is received within the holding member, that is, the bight of the wiping strip, is not used for cleaning purposes in any manner.

SUMMARY OF THE INVENTION

Accordingly, it is a general object of the present invention to avoid the disadvantages of the prior art.

More particularly, it is an object of the present invention to develop a floor cleaning device or the like which is not possessed of the disadvantages of similar prior art devices.

Yet another object of the present invention is to so construct such a device as to be simple, easy to manufacture and reliable in operation nevertheless.

A further object of the present invention is to devise a cleaning devise which is easily disassembleable and reassembleable for replacing a worn-out cleaning element or for repositioning the same with respect to a holding member.

A concomitant object of the present invention is to reduce the consumption of the material of the cleaning element by extending the useful lifetime of the latter.

In pursuance of these objects and others which will become apparent thereafter, one feature of the present invention resides, briefly stated, in a device for cleaning surfaces, particularly floors, which comprises at least one cleaning element having a plurality of cleaning edges and a plurality of passages which extend through the cleaning element; means for mounting the cleaning element so that one of the cleaning edges is in an exposed working position for cleaning movement over a surface to be cleaned, including a housing member of generally U-shaped cross section, having a bight and two arms together bounding a recess for partially receiving said cleaning element so that said passages extend from one to the other of said arms, and an actuating portion for moving the holding member with the cleaning element mounted therein over the surface; and means for connecting the cleaning element to the holding member, including a plurality of connecting members connected to said holding member and received in respective ones of the passages.

In a disclosed species, each of said connecting members is affixed to one of said arms of the holding member and extends therefrom toward the other arm; then, the mounting means includes means for removably attaching at least one of the arms to the bight of the mounting member for introducing the connecting members into and removing the same from the respective passages upon removal of the removable arm. All of the connecting members may be affixed to the same arm, and the attaching means may attach the other arm of the holding member to the bight thereof. According to a further aspect of the present invention, the connecting means includes a mounting member juxtaposable with one of the above-mentioned arms, and means for removably attaching the mounting member to the holding member. The connecting members are affixed to the mounting member and extend therefrom toward the other arm upon juxtaposition of the mounting member with the one arm of the holding member. Preferably, such mounting member is plate-shaped. When the cleaning element and the holding member are constructed in the above-discussed fashion, an easy and rapid insertion of the cleaning element into the holding member is possible in that, according to the first concept of the present invention, it is merely necessary to remove the removable arm of the holding member so as to expose the connecting members or bolts fixed to the one arm of the holding member, then a new cleaning element, or an old cleaning element in a new position, can be slid over the projecting connecting members, whereupon the removable arm is re-connected to the remainder of the holding member. According to an additional aspect of the present invention, the new cleaning element, or again the old cleaning element in a new position, is slid over the free ends of the bolts or similar connecting members and then the plate to which the bolts are connected is assembled with the holding member.

The cleaning element, whose one or more cleaning edges have become worn during the previous operations, can be rotated through 180°, either about its longitudinal axis or about its transverse axis, so that eventually all four of the longitudinal cleaning edges can be brought into their working positions, one after the other. In other words, that cleaning edge which is originally exposed but not in the working position thereof, as well as the two cleaning edges which are originally received in the recess of the holding member, are eventually brought into the working position upon the wear and deterioration of the previously used cleaning edges.

A result of this is that the cleaning elements have, for all intents and purposes, a lifespan which is of double length as compared to what is presently known, in that four, rather than two, cleaning edges can be seriatim brought into the working position thereof. On the other hand, the holding member need be purchased only once in that the cleaning elements can be replaced by new ones every now and then, after completely wearing out the previously used ones, for an indefinite period of time many times exceeding the useful life of any of the cleaning elements used in connection therewith.

When the bolts or similar connecting members are affixed to the plate-shaped mounting member, the mounting of the cleaning element on, or its dismounting from, the holding member is performed by the insertion or removal of the plate-shaped mounting member on which the cleaning element is mounted, and thereupon connecting such mounting member to the holding member, for instance by screws or the like.

To advantage, the passages for the connecting members are provided in the central region of the cleaning element, which results in a situation in which always a certain section of the cleaning element which has predetermined dimensions extends outwardly of the holding member. This reflects positively on the cleaning operation proper. Preferably, the passages are so provided in the cleaning element that they are arranged in a row along a longitudinal axis of the cleaning element and are spaced from one another in the longitudinal direction of the cleaning element.

The bolts or similar connecting members are so arranged in fixed relation to one of the arms of the holding member or to the plate-shaped mounting member that they correspond in their distribution, height and number to those of the passages in the cleaning element. In this manner, it is possible to rapidly remove the cleaning elements from the mounting member and again insert the same into the holding member, since the connection of the cleaning elements is always performed in the central region thereof. In view of the fact that a part of the cleaning element projects outwardly of the holding member, the region of the holding member at which the connecting members are affixed, that is the region of one of the arms or a similar region of the plate-shaped mounting member, is situated at the free ends of the arms of the holding member.

According to a further advantageous aspect, some of the bolts or similar connecting members, such as at least the terminal bolts of the row thereof, or even some of the central bolts, depending on the length of the cleaning element, have free end portions which are received in openings of the other arm of the holding member, that is, the arm to which the connecting members are not affixed in the disassembled condition. Preferably, such free end portions are threaded, and connecting elements, such as nuts, are threaded onto such threaded free end portions of the connecting elements. In this manner, the removable arm of the holding member is connected to the remainder of the holding member. In addition thereto, tightening of such connecting elements results in clamping of the cleaning element between the two arms of the holding member. The threaded connection can be easily and quickly disassembled and reassembled either by hand or using a screwdriver, a wrench or a similar tool, when it is desired to reposition the cleaning element relative to the holding member, or to replace a cleaning element which is completely worn out.

The holding member, which is substantially U-shaped in cross section, may consist of an L-shaped rail which includes one of the arms and the bight, and a strip-shaped element which is removably connected to the L-shaped element. These elements may be, for instance, of a metallic material. The connection of these two parts occurs in such a manner that these two parts always retain their spatial position relative to one another. To this end, a marginal portion of the bight of the holding member and the border region of the removable arm of the holding member can be provided with respective grooves and projections which are complementary to one another.

The actuating portion of the holding member may be configurated as a socket into which a handle stick or the like, for instance, an extension rod, may be inserted or threaded.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DISCUSSION OF THE PREFERRED EMBODIMENTS

Figure 1:
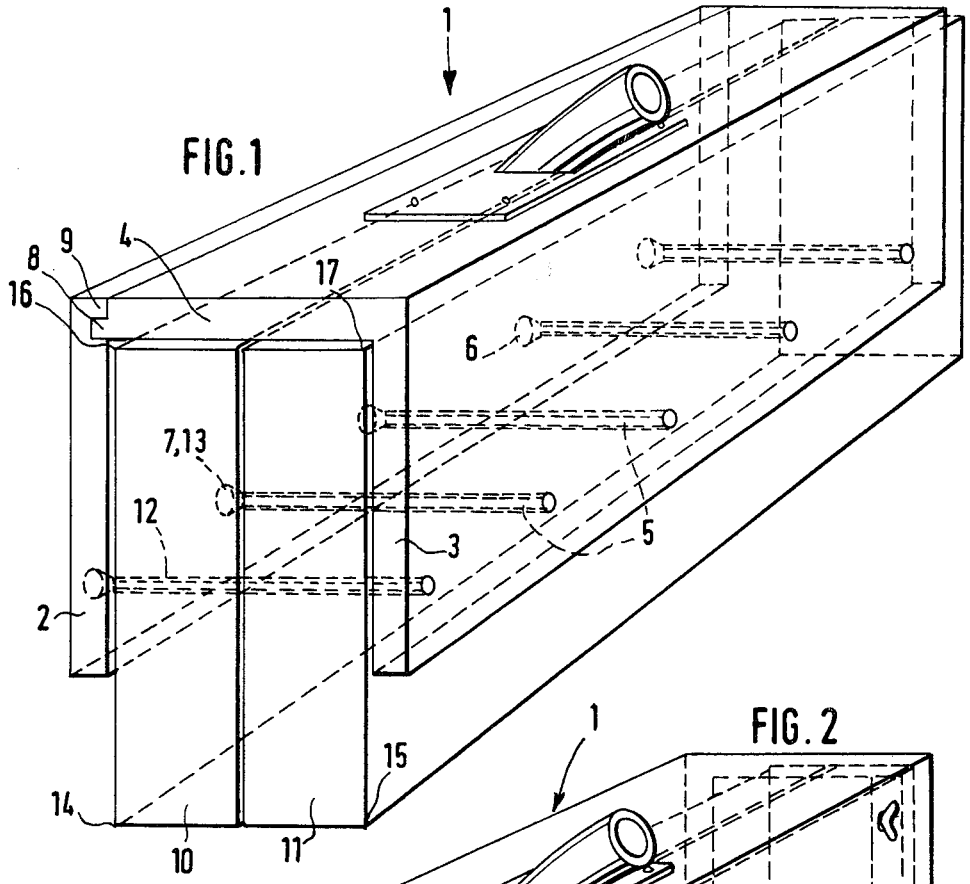
FIG. 1 is a perspective view of a device with a removable arm of a holding member.
Figure 2:
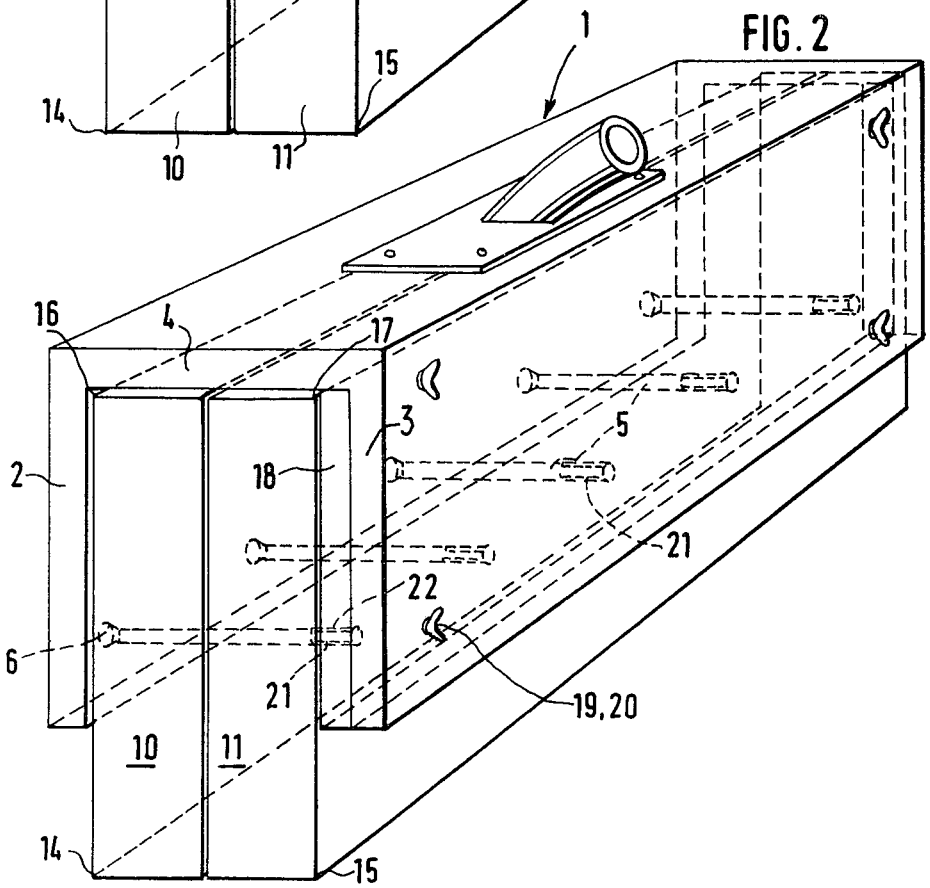
FIG. 2 is a view similar to FIG. 1, but of the preferred device, with a one-piece holding member.

Referring now to the drawing in general, it may be seen that the cleaning device illustrated therein has a multitude of identical or similar parts occurring both in the basic device of FIG. 1 as well as in the modified device of FIG. 2, so that the same reference numerals have been used to designate the same or similar parts.

Referring now to FIG. 1, it may be seen that the reference numeral 1 has been used to designate a holding member in toto. The holding member 1 is of a generally U-shaped cross section and includes an L-shaped member having an arm 3 and a bight 4, while a strip-shaped arm 2 is removably connected to the bight 4.

The arm 3 of the holding member 1 is provided with projecting bolts 5 or similar connecting members which are affixed to the arm 3 and extend, in the assembled position, up to the oppositely located arm 2 of the holding member 1. The bolts 5 can be affixed to the inner side of the arm 3 of the holding member 1 by threaded connections, riveted connections, or by welded connections. The free ends 6 extend all the way up to the inner side of the removable arm 2 of the holding member 1. Alternatively, these free end portions 6 can extend into openings or depressions provided in the removable arm 2 of the holding member 1.

In the illustrated example of FIG. 1, the two outer bolts 5 pass through the removable arm 2 of the holding member 1, their free ends being provided with an external thread onto which there are threaded internally threaded nuts 7. These threaded nuts 7 serve the purpose of connecting the removable arm 2 of the holding member 1 to the component which consists of the bight 4 and of the arm 3 of the holding member 1. To positively support the arm 2 on the component 3, 4, the marginal portion of the bight 4 of the holding member 1 is formed with a groove 8, in which there is received a projection 9 provided on a border region of the removable arm 2. The shape of the groove 8 is complementary to that of the projection 9 so that the arm 2 is forced to assume the proper position relative to the bight 4 of the holding member 1. When the device of the present invention is quite long, a further conventional holding arrangement can be provided at the removable arm 2 in the region of the groove 8 and of the projection 9.

The two arms 2, 3 and the bight 4 together bound a recess in the interior of the holding member 1, and two cleaning elements 10 and 11, each of a rectangular cross section, are arranged parallel to one another and have passages 12 in the middle region thereof for the passage of the connecting bolts 5 therethrough. The passages 12 are arranged in the central region of the cleaning elements 10 and 11, preferably in a row which extends in the longitudinal direction of the cleaning elements 10 and 11, and in registry with the bolts 5.

Having so described the construction of the cleaning device, the assembly and disassembly thereof will be now briefly explained. When the cleaning elements 10, 11 are to be mounted in the holding member 1, the removable arm 2 of the holding member 1 is removed first, after loosening of the threaded nuts 7 and their removal, and then the cleaning elements 10 and 11 are juxtaposed with the arm 3 so that the bolts 5 are in registry with the passages 12, whereupon the cleaning elements 10 and 11 are slid, with their passages 12, onto the bolts 5. After that, the arm 2 is reassembled with the remainder of the device so that openings 13 are in alignment with the free ends of the terminal or outer bolts 5, after which the threaded nuts 7 are threaded onto the free ends of such bolts 5 and tightened, whereby the removable arm 2 is rigidly connected to the remainder of the holding member 1 and the cleaning elements 10, 11 are securely partially received in the recess bounded by the arms 2, 3 and the bight 4. The removal of the elements 10, 11 occurs in the reverse order.

As further seen in FIG. 1, the cleaning elements 10, 11 have, for instance, four cleaning edges designated with reference numerals 14, 15, 16 and 17, respectively. In the illustrated position, the cleaning edge 14, for instance, is used for the cleaning operation. When the cleaning edge 14 becomes worn out, the cleaning elements 10, 11 are taken out of the holding member 1 in the above-discussed manner, rotated about their transverse axis through 180°, and then again inserted into the holding member 1. When this happens, the cleaning edge 15 assumes the working position and, from now on, takes over the cleaning function. When even the cleaning edge 15 is worn out, the cleaning elements 10, 11 are again taken out of the holding member 1 and again rotated, this time about its longitudinal axis, through 180° so that now it is the cleaning edges 16, 17 which are exposed at the exterior of the holding member 1. Thus, one of such cleaning edges 16, 17 will be in the working or cleaning position and, when this cleaning edge is worn out, the remaining cleaning edge is finally used in its stead, similarly to what has been described above in connection with the cleaning edges 14 and 15.

Referring now to FIG. 2, it may be seen that the holding member 1 is of one piece, such as a U-shaped profiled section.

A plate-shaped mounting member 18 is arranged at the inner side of the arm 3, being connected thereto by means of external thumbscrews 19 passing through holes 20 in arm 3 and engaging threaded holes in plate 18. The plate-shaped mounting member 18 has the connecting members, such as bolts 5 fixed thereto. So, for instance, the bolts 5 have threaded portions 21 which are threaded into corresponding bores 22 provided in the plate-shaped mounting member 18. The bolts 5 extend all the way up to the inner side of the opposite arm 2 of the holding member 1, so that the free ends 6 of such walls are juxtaposed with such inner side. Instead of a threaded connection, the respective ends of the bolts 5 can also be connected to the plate-shaped mounting member 18 by means of riveted or welded connections.

The introduction of the cleaning elements 10, 11 into the holding member 1 is accomplished by loosening the thumbscrews 19 so that the plate-shaped mounting member 18 can be pulled out of the interior of the holding member 1, together with the cleaning elements 10, 11 supported thereon, either laterally or downwardly as illustrated in FIG. 2. After this, the cleaning elements 10, 11 can be pulled off the free ends 6 of the bolts 5 and, after rotating the cleaning elements 10, 11 either about their longitudinal or about their transverse axes, the cleaning elements 10, 11 can be repositioned on the bolts 5. Afterwards, the plate-shaped mounting member 18, with the cleaning elements 10, 11 supported thereon, is reintroduced into the recess provided in the one-piece holding member 1.

It will be understood that each of the elements described above, or two or more together, may also find a useful application in other types of constructions differing from the types described above.

While the invention has been illustrated and described as embodied in a floor-cleaning device, it is not intended to be limited to the details shown, since various modifications and structural changes may be made without departing in any way from the spirit of the present invention. For instance, instead of using two cleaning elements 10 and 11, only one such cleaning element, or more than two, can be used. Also, whenever desired, the positions of the cleaning elements 10 and 11 relative to one another can be switched so that even those cleaning edges which are adjacent to one another in the central region of the assembly 10, 11, can be used for cleaning purposes.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A device for cleaning surfaces, particularly floors, comprising a plurality of elongated cleaning elements of foam rubber which are symmetrical with reference to their central longitudinal and their central transverse axes, a plurality of cleaning edges extending longitudinally of each of said cleaning element at a predetermined distance from said axes, and a plurality of transverse passages which are distributed along said central longitudinal axes with spacing from one another in the central region of said cleaning element and extend through the latter; means for so receiving said cleaning element that any of said cleaning edges is in an exposed working position for a cleaning movement over a surface to be cleaned, including an elongated one-piece holding member of a generally U-shaped cross section having a bight and two arms rigid with one another and together bounding a recess for so partially accommodating said cleaning element that said passages extend from one to the other of said arms; means for connecting said cleaning element to said holding member, including a plate-shaped mounting member juxtaposable with said one arm within said recess, a plurality of connecting members of a number and distribution corresponding to those of said passages to be respectively received therein and affixed to said mounting member to extend therefrom toward said other arm, and detachable securing means for removably securing said plate-shaped mounting member to said one arm of said one-piece holding member, so that, upon release of said securing means and removal of the unit constituted by said plate-shaped mounting member from said recess and the cleaning element carried thereby, said cleaning element can be reoriented relative to said plate-shaped mounting member to put any other of said cleaning edges thereof into said exposed working position upon reintroduction of said plate-shaped mounting member into said recess; and an actuating handle rigid with said one-piece holding member and operative for moving the same with said plate-shaped mounting member and cleaning element connected thereto over the surface being cleaned with the respective cleaning edges in contact therewith.

2. A device as defined in claim 1, wherein said holding member is of metallic material.

3. A device as defined in claim 1, wherein said connecting members are bolts.

* * * * *